US005240253A

United States Patent [19]

Cooper

[11] Patent Number: 5,240,253

[45] Date of Patent: Aug. 31, 1993

[54] PRACTICE AID GOLF CLUB PUTTER

[76] Inventor: Gene E. Cooper, P.O. Box 616603, Orlando, Fla. 32861

[21] Appl. No.: 856,388

[22] Filed: Mar. 24, 1992

[51] Int. Cl.[5] ..... A63B 69/36

[52] U.S. Cl. ..... 273/186.2; 273/171; 273/194 B

[58] Field of Search ..... 273/167 J, 167 C, 186 A, 273/175, 194 R, 194 A, 194 B, 186.2, 187.4, 186.5, 193 R, 193 A, 193 B

[56] References Cited

U.S. PATENT DOCUMENTS

| | | | |
|---|---|---|---|
| 1,435,318 | 11/1922 | Mattern | 273/173 |
| 3,194,564 | 7/1965 | Swan | 273/186.2 |
| 3,384,376 | 5/1968 | Greenlee | 273/167 C X |
| 3,730,529 | 5/1973 | Donofrio | 273/186 A |
| 4,025,078 | 5/1977 | Pelz | 273/186.2 |
| 4,720,110 | 1/1988 | Hurst | 273/186.2 |

FOREIGN PATENT DOCUMENTS

| | | | |
|---|---|---|---|
| 277146 | 9/1927 | United Kingdom | 273/175 |
| 325744 | 2/1930 | United Kingdom | 273/167 J |

*Primary Examiner*—George J. Marlo
*Attorney, Agent, or Firm*—Warren L. Franz

[57] ABSTRACT

A golf club putter includes an elongated cylindrical extension removably secured to project forwardly along the club head centerline and providing a cue stick-like tip for learning to strike a ball squarely during practice. For play, the extension is either relocated along the centerline behind the club face, or replaced by an insert, to maintain the club weight constant for play.

8 Claims, 1 Drawing Sheet

PRACTICE AID GOLF CLUB PUTTER

This invention relates to golf club putters, in general; and in particular to a golf club putter having an elongated projection that acts as a stroke improvement aid during practice and that is removable or repositionable to be out of the way during play.

BACKGROUND OF THE INVENTION

In golf, the desired putt is always a straight putt, with the lay of the land and speed of the ball controlling the break. Most experienced golfers can visualize the line of the stroke that the ball should take. Their problem is getting the ball to travel the intended line. They may twist and close, or open and push the ball, but not strike the ball squarely to propel it along the visualized line. If the putt is short, even an unsquare hit can sink the ball. For longer putts, though, a square hit is essential.

In billiards or pool, a ball squarely hit, with the tip of the cue stick on its vertical centerline will travel a straight line. In order to make it go along its intended line, the cue must be driven axially smoothly through the ball on that line. Practice creates muscle and eye "memory" that enables repetition of a good, clean shot, time after time. It is easier to perfect cue stick shots, than putter shots. If the tip of the cue stick hits the ball at an angle, it will not go straight, even over short distances.

SUMMARY OF THE INVENTION

It is an object of the present invention to provide a golf club putter, usable in practice to aid a player to acquire the straight-through stroke necessary for the ball to travel along its intended line, and usable in play to implement the skills learned during practice.

In accordance with the invention, an elongated cue stick-like extension is added centrally perpendicular to the "sweet spot" of the striking face of a conventional golf club putter, to serve as a striking and follow-through aid during practice. The extension is made removable, so that the same club used for practice can be used during actual play.

In one embodiment of the invention, described in greater detail below, the extension is repositionable from the front to the rear of the club head, to provide a sighting line and to maintain the same weight of the club during play as during practice. During play, the extension fills the hole left in the face when the extension is removed from the front and repositioned to the rear. The tip of the extension is suitably made of leather, rubber or metal, and may be integral with or separable from the main body portion of the extension.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DETAILED DESCRIPTION OF PREFERRED EMBODIMENTS

Figure 1:
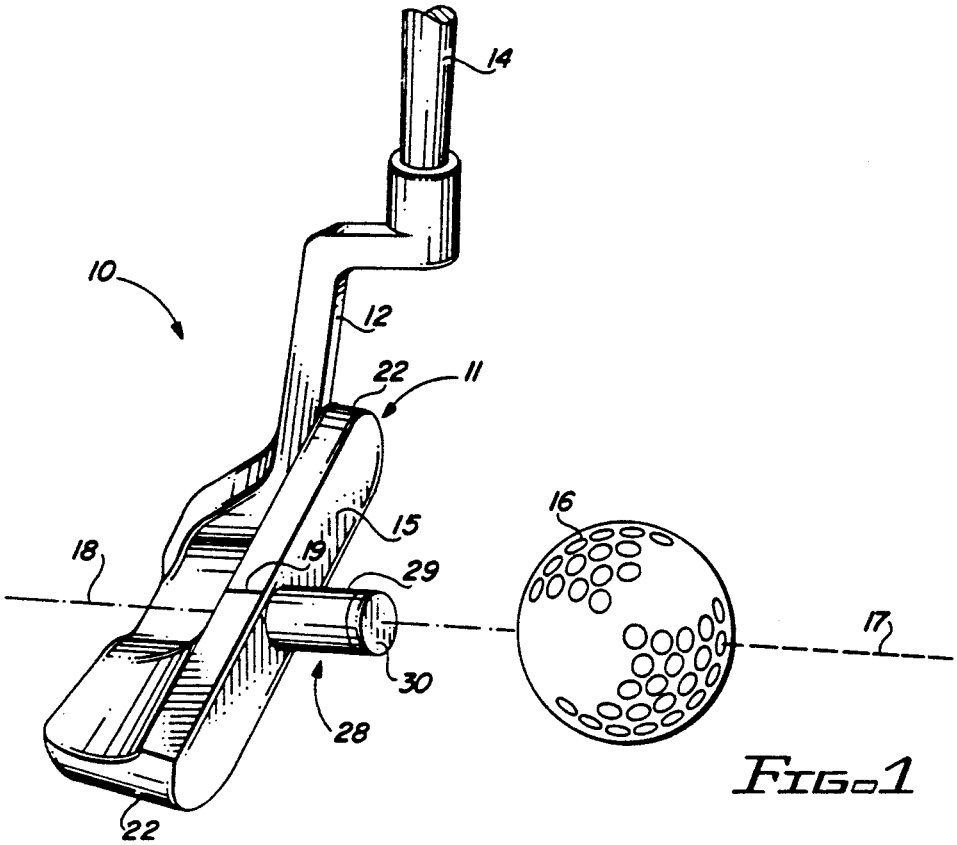
FIG. 1 is a front perspective view of a first embodiment of golf club putter in accordance with the invention, shown in its practice configuration.

As shown in FIG. 1, a golf club putter 10 comprises a weighted head 11 attached by means of a neck 12 at the base of a shaft 14. In accordance with conventional design, the head 11 includes a planar face 15 for striking a ball 16 along an intended line of travel 17 coincident with a weight balance centerline 18 of the head 11. To assist in this regard, the head 11 may include an aiming guideline or groove 19, parallel with centerline 18, as shown.

The invention may be implemented for use with any conventional design of putter. For the particular putter 10, illustrated in FIGS. 1 and 2, the rear of head 11 is contoured to smoothly taper downwardly and inwardly toward the centerline 18, from toe and heel top edges 21, 22 of face 15 to a central, horizontal planar region 23 located behind a vertically extending rear face portion 25 of the head 11. This contour is typical of the heads of putters, such as those available commercially under the "Ping TM" mark.

In accordance with the principles of the present invention, the club 10 includes an elongated cylindrical extension member 28 attached coaxially with the centerline 18 to project forwardly from and more or less perpendicular to the plane of face 15 (depending on the lie of the face of the particular putter). The member 28 includes a main cylindrical body portion 29 of diameter less than the height (vertical extent) of the head 11, and a tip 30 located at its front end. The length of the extension 28 is preferably less than the width (extent in centerline 18 direction) of the planar region 23 of head 11. A reduced diameter threaded shank 31 projects axially, rearwardly from the rear of the body 29, for releasible engagement with a complementary threaded bore 26 that passes through the head 11. Bore 18 is coaxial with the centerline 18, opening centrally onto face 15 at the front and onto face 25 at the rear. The shoulder formed by the reduction in diameter at the rear of the body 29 has a planar annular surface 32 that matches the front of the face 15, when the shank 31 is fully threaded into the bore 26 from the front. The tip 30 is of leather, rubber, metal or other material which provides a leading surface perpendicular to the centerline 18 with which to strike the ball 16. In appearance, the extension 28 resembles the front end of a billiard or pool cue stick.

In operation, the putter 10 is prepared for practice by threading the shank 31 of extension 28 from the front of head 11, fully into the bore 26, to bring the rear planar surface of body 29 flush against the face 15 of head 11. In this position, the body 29 projects forwardly, perpendicular to face 15 coaxially with the centerline 18, with tip 30 oriented perpendicular to centerline 18 and acting as the point of striking contact with the ball 16. The putter 10 is then swung to strike the ball 16 squarely, vertically slightly above its center to propel it with a forward roll along its intended line of travel 18. Because of the small dimension of tip 30, unless the ball 16 is squarely struck, its path will deviate from the intended line 18. The swing can, thus, be adjusted and practiced until the ball 16 goes straight, time after time.

To ready the putter 10 for use in normal play, the extension 28 is unscrewed from the bore 26, leaving the striking face 15 in its unobstructed normal, play-ready condition. The extension 28 may now be conveniently stored above the planar region 23, at the rear of the head 11, behind the rear face 25. For this purpose, shank 31 is now threaded into the bore 26 from the rear, bringing the rear surface of body 29 into abutment with the rear face 25. A shallow circular groove 33 having an internal surface parallel to the plane of the front face 15 ensures that the body 29 will be flush with the face 15 when the extension 28 is fully threaded into the bore 26. The extension 28 will thus be secured in the position 28' indicated by dot-dashed lines in FIG. 2, out of the way above the region 23 at the rear of the head 11. To fill the hole left by bore 26, insert 28 is dimensioned so that, when it is fully threaded from the rear into bore 26, a surface 34 of shank 3 will be brought parallel to and flush with face 15.

The described extension 28, when brought into the putter practice position shown in FIG. 1, provides a cue stick-like practice aid useful for improving a player's club swing and head approach in addressing the ball 16 with the putter. The elongation provided by the cylinder body 29 assists the player's eye to bring the club through the vertical center of the ball 16 and along the sight line 17, and the tip 30 provides immediate feedback on the correctness of the approach. The correct "feel" learned in practice will be remembered later when the extension 28 is relocated to the rear face 25 of the club for actual play. Though not critical to the utility of the invention, by relocating rather than removing the extension 28, the sight line and weight of the club are maintained constant for both practice and play.

Figure 2:
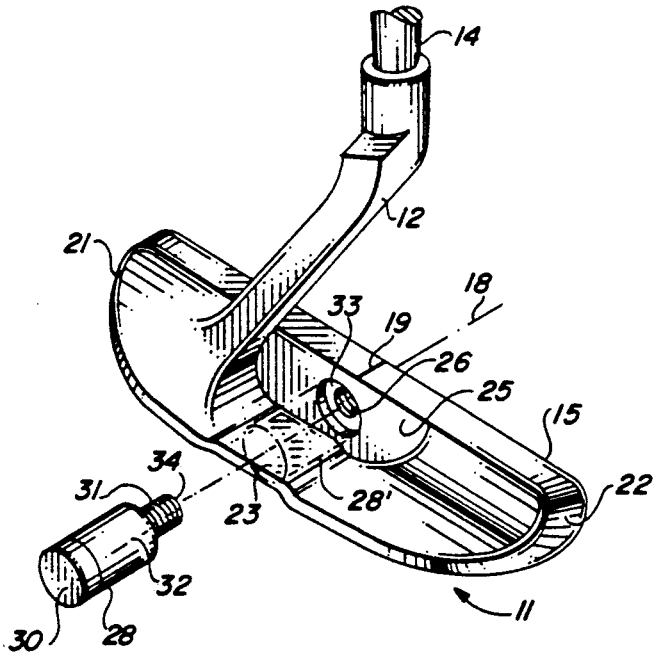
FIG. 2 is a rear perspective view of the same putter, shown being readied for play.
Figure 3:
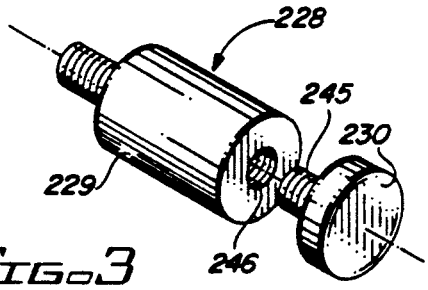
FIG. 3 is a perspective view of a modified form of the putter extension element of the putter of FIGS. 1 and 2.

FIG. 3 shows a modified form 228 of the extension 28, described above, which has a removable tip end 230, and which can be used in place of extension 28 in the putter 10 embodiment shown in FIGS. 1 and 2. A threaded shank 245 projects rearwardly opposite the non-striking surface of tip 230, for threading into a correspondingly threaded bore 246 of a main cylindrical body portion 229. Forming the extension 228 in this manner enables the convenient replacement of a new tip 230 for a worn one, or the interchange of one type of tip 230 for another. The tip 230 can, if desired, actually be the same tip available commercially for threading onto the leading end of a conventional cue stick.

Those skilled in the art to which the invention relates will appreciate that other substitutions and modifications can be made to the described embodiment without departing from the spirit and scope of the invention as described by the claims below.

What is claimed is:

1. In a golf club putter having a head attached to a base of a hand-grippable shaft, said head having a front, a rear and a centerline, and said front including a face suitable for striking a ball during play; the improvement comprising:

an elongated extension including a main body portion and a tip;

means for releasibly securing said extension in fixed position to said head for alternative placement either at said front, with said extension projecting outwardly and forwardly from said face in alignment with said centerline, so that said tip is presented as a ball-striking element on said putter; or at said rear, with said extension projecting rearwardly in alignment with said centerline, in nonobstructing position relative to said face;

said releasibly securing means comprising an internally-threaded bore formed in said head and opening onto said face; and said extension including a rear end opposite said tip, and external threading at said rear end that matches said internal threading of said bore, so that said rear end will be brought flush with said face when said rear end is fully threaded into said bore from said rear.

2. An improvement as in claim 1, wherein said head has a height, and said main body portion comprises a cylindrical member having a diameter less than said height.

3. An improvement as in claim 1, wherein said main body portion comprises a cylindrical member of a certain diameter and an externally-threaded shank of diameter less than said certain diameter, said shank being located at said rear end and defining a shoulder having an annular surface that can be brought flush against said face when said extension is secured to said head at said front.

4. A golf club putter usable as a practice aid, said putter comprising:

a hand-grippable shaft having a base; a head attached to said base of said shaft, said head having a front, a rear, a bore extending from said front to said rear, a height and a centerline; said front including a face suitable for striking a ball during play, and onto which said bore opens; and an elongated extension including a cylindrical body member having a rear and tip ends; said body member having a diameter less than said height and said rear end including means, insertable through said bore, for releasibly securing said extension in fixed position to said head either at said front, with said body member projecting outwardly and forwardly from said face in alignment with said centerline, so that said tip end is presented as a ball-striking element on said putter; or at said rear, with said extension projecting rearwardly in alignment with said centerline, in a nonobstructing position relative to said face, and with a surface of said rear end filling said bore opening onto said face.

5. A golf club putter as in claim 4, wherein said body member tip end comprises a separate element, and said extension further comprises means releasibly attaching said separate element on said body member.

6. A method of putting, during both practice and play, using a golf club putter having a head attached to a base of a hand-grippable shaft, said head having a front, a rear, a height and a centerline; and said front including a face suitable for striking a ball during play; the method comprising the steps of:

providing an internally-threaded bore through said head, from said front to said rear and opening onto said face;

providing an elongated extension including a cylindrical body member having rear and tip ends; said body member having a diameter less than said height and said rear end being externally-threaded to match the internal threading of said bore;

attaching said extension in fixed position to said front by threading said rear end into said bore, so that said extension projects outwardly and forwardly from said face in alignment with said centerline; and swinging said putter with said extension attached so that said tip end strikes a ball; whereby said extension acts as a stroke improvement aid during practice;

removing said extension from said face by unthreading said rear end from said bore;

reattaching said extension in fixed position to said rear by threading said rear end into said bore, so that said extension projects rearwardly in alignment with said centerline, in a nonobstructing position relative to said face and with a surface of said rear end brought flush to fill said bore opening onto said face; and swinging said putter with said extension reattached so that said face strikes said ball; whereby said reattachment of said extension acts to keep the weight of said putter the same during this swinging step as during the previous swinging step.

7. A method as in claim 6, wherein said rear has a vertically extending rear face portion, and a horizontal planar region located behind said rear face portion; said horizontal planar region has a width dimension in a direction of said centerline; and said means for releasibly securing serves for releasibly securing said extension to said rear at said rear surface with said extension projecting rearwardly in alignment with said centerline for a distance less than the width of said planar region.

8. A method as in claim 6, wherein said main body portion comprises a cylindrical member of a certain diameter and an externally-threaded shank of diameter less than said certain diameter, said shank being located at said rear end and defining a shoulder having an annular surface; said rear end includes a rear surface; and said rear face portion includes a circular groove surrounding said bore and having an internal surface parallel to said face for ensuring that said rear end surface will be brought parallel to said face when said rear end is fully threaded into said bore from said rear.

* * * * *